US008485069B1

(12) United States Patent
Chen

(10) Patent No.: US 8,485,069 B1
(45) Date of Patent: Jul. 16, 2013

(54) WRENCH WITH A RATCHET DEVICE

(76) Inventor: Yi-Fu Chen, Taichung (TW)

( * ) Notice: Subject to any disclaimer, the term of this patent is extended or adjusted under 35 U.S.C. 154(b) by 0 days.

(21) Appl. No.: 13/535,367

(22) Filed: Jun. 28, 2012

(51) Int. Cl.
*B25B 13/46* (2006.01)

(52) U.S. Cl.
USPC ..... 81/63; 81/60; 81/61; 81/62; 81/63.2

(58) Field of Classification Search
USPC ..... 81/60–63.2
See application file for complete search history.

(56) References Cited

U.S. PATENT DOCUMENTS 6,282,991 B1 * 9/2001 Hu ..... 81/63.2
6,435,062 B1 * 8/2002 McCann ..... 81/63
6,981,435 B2 * 1/2006 Hsien ..... 81/63.2
7,185,566 B2 * 3/2007 Arnold et al. ..... 81/63.2
2005/0011314 A1 * 1/2005 Chen ..... 81/63

* cited by examiner

*Primary Examiner* — Monica Carter
*Assistant Examiner* — Danny Hong

(57) ABSTRACT

A wrench with a ratchet device includes a wrench body, a driving set, a cover member and a controlling member. A hole is opened on the wrench body. A receiving space is defined near the hole. An assembling groove is defined near the receiving space. The controlling member is assembled into the receiving space. The driving set has a ratchet and a driving block. The ratchet is assembled into the hole and the driving block is assembled into the receiving space. The driving block abuts against a bottom of the receiving space. The ratchet is engaged with the driving block. The controlling member has a switching member inserted into the assembling groove to move the driving block. Under this arrangement, when the ratchet engages with the driving block, the driving block is stable because the bottom of the receiving space abuts against the driving block.

7 Claims, 5 Drawing Sheets

WRENCH WITH A RATCHET DEVICE

BACKGROUND OF THE INVENTION

1. Field of the Invention

The present invention relates to a wrench, and more particularly to a wrench with a ratchet device.

2. Description of Related Art

A conventional wrench comprises a body having a hole, a first receiving groove, a locking groove, and a first abutting shoulder, the hole having a receiving room defined at one side thereof, a controlling groove and a bead groove defined near the receiving room, a ratchet wheel having a sleeving part, a plurality of engaging teeth defined around the outer periphery of the ratchet wheel, the ratchet wheel rotatably set into the hole, a controlling block assembled into the receiving room, only one side of the controlling block abutting against a bottom of the receiving room, the controlling block having a plurality of driving teeth defined at one side thereof, the controlling block engages with the engaging teeth via the driving teeth, a concave surface defined at another side of the controlling block, two protrusions defined at two sides of the concave surface, a controlling member having an aperture, two top faces respectively defined at two sides of the aperture, the two top faces respectively abutting against the two protrusions, the controlling member rotatably assembled into the controlling groove, a first resisting cap and a first elastomer received into the aperture, the first resisting cap abutting against the concave surface, a second resisting cap and a second elastomer received into the bead groove, the second resisting cap abutting against one recession of the controlling member.

However, the conventional wrench has a disadvantage as following.

When the controlling block engages with the engaging teeth of the ratchet wheel, the controlling block would not be stable enough because only one side of the controlling block abuts against the bottom of the receiving room.

The present invention has arisen to mitigate and/or obviate the disadvantages of the conventional wrench.

SUMMARY OF THE INVENTION

The main objective of the present invention is to provide a wrench.

To achieve the objective, a wrench with a ratchet device comprises a wrench body, a driving set, a cover member and a controlling member, a hole opened at one end of the wrench body therethrough, a receiving space axially defined on an inside wall of the hole relative to the wrench body, the receiving space being corresponding to another end of the wrench body, a side entry opened on one side of the receiving space, an assembling groove axially defined at a bottom of the receiving space relative to the wrench body, the controlling member assembled into the assembling groove, a positioning groove axially defined at a bottom of the assembling groove relative to the wrench body, the driving set having a ratchet and a driving block, the ratchet assembled into the hole, a plurality of teeth defined around an outer periphery of the ratchet, the driving block assembled into the receiving space, two abutting faces respectively defined at two ends of the driving block, the two abutting faces both abutting against the bottom of the receiving space, two engaging parts defined on one side of the driving block, the two engaging parts being close to each other, the two engaging parts being both corresponding to the ratchet, the teeth of the ratchet selectively engaged with one of the two engaging parts, the cover member covering the hole and the side entry of the receiving space, a cover opening opened on the cover member, the cover opening being corresponding to the ratchet and being used to sleeve a top of the ratchet, the controlling member having a switching member, a first elastomer and a second elastomer, the switching member inserted into the assembling groove and being rotatable relative to the assembling groove, the switching member having two indentations defined thereon, the two indentations being close to each other, the positioning groove being selectively corresponding to one of the two indentations, the first elastomer assembled onto the positioning groove to selectively abut against one of the two indentations of the switching member, the second elastomer assembled on the switching member to abut against the driving block. Wherein, the driving block has an attaching groove defined at another end thereof; the attaching groove is corresponding to the second elastomer; wherein when the user rotates the switching member, the second elastomer compresses against the attaching groove of the driving block so that the driving block is moved smoothly; the switching member has a spring room opened thereon; the spring room is corresponding to the attaching groove; one end of the second elastomer abuts against a bottom of the spring room, and another end of the second elastomer abuts against the attaching groove of the driving block to smoothly move the driving block; the first elastomer has a first spring and a first positioning component; the second elastomer has a second spring and a second positioning component; one end of the first spring of the first elastomer abuts against the bottom of the positioning groove; another end of the first spring compresses against the first positioning component so that the first positioning component of the first elastomer selectively abuts against one of the two indentations via the compression of the first spring; one end of the second spring of the second elastomer abuts against the bottom of the spring room; another end of the second spring compresses against the second positioning component of the second elastomer so that the second positioning component of the second elastomer abuts against the attaching groove of the driving block via the compression of the second spring; the bottom of the receiving space is concave-shaped; the two abutting faces of the driving block are both convex-shaped so as to be corresponding to the bottom of the receiving space; a positioning circular groove is defined around a periphery of the cover opening of the cover member; a limiting annular groove is defined on the inside wall of the hole of the wrench body; the limiting annular groove is corresponding to the positioning circular groove; a locking ring is assembled on the positioning circular groove; the outer periphery of the locking ring is plugged into the limiting annular groove so that the locking ring is tightly positioned at the inside wall of the hole.

Under this arrangement, when the ratchet is rotated relative to the wrench body in one direction, the teeth of the ratchet are engaged with one engaging part of the driving block; in contrast, when the ratchet is rotated relative to the wrench body in another direction, the teeth of the ratchet are disengaged with one engaging part of the driving block step by step.

Further benefits and advantages of the present invention will become apparent after a careful reading of the detailed description with appropriate reference to the accompanying drawings.

DETAILED DESCRIPTION OF THE INVENTION

Figure 1:
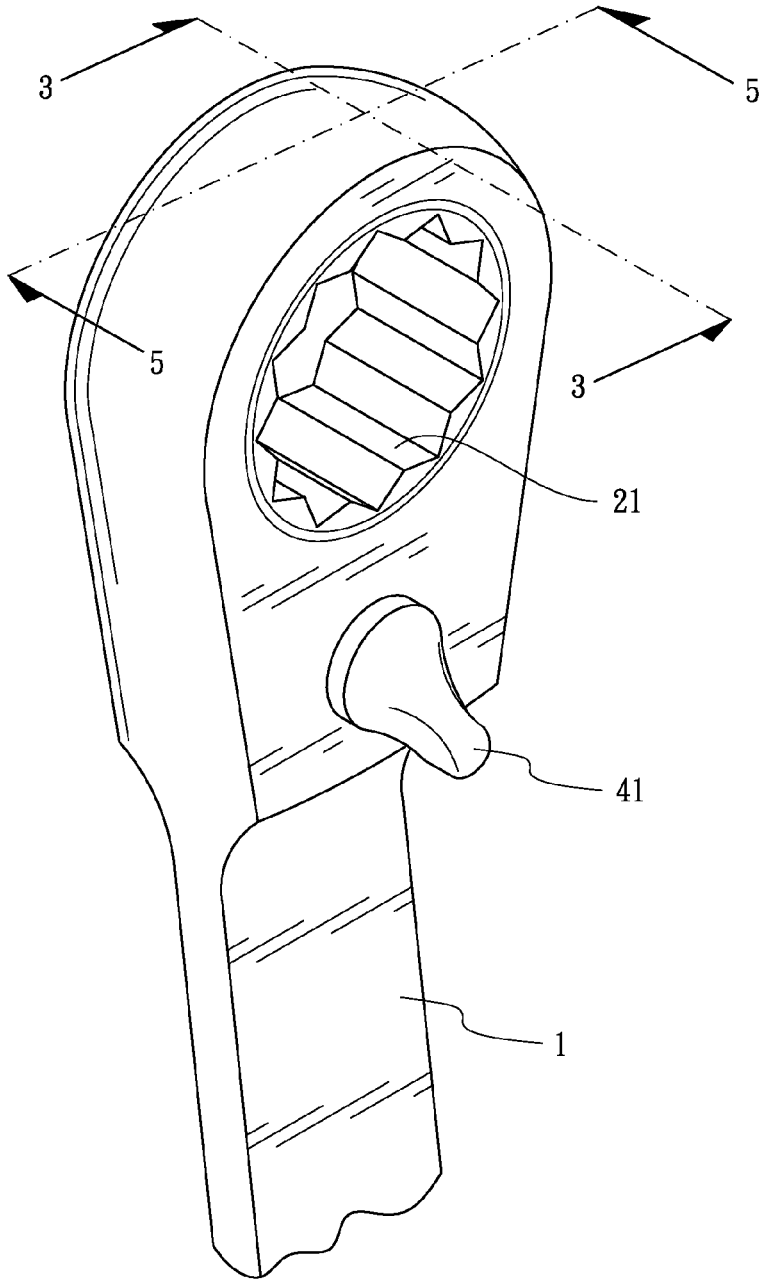
FIG. 1 is a perspective view of a wrench with a ratchet device of the present invention.
Figure 2:
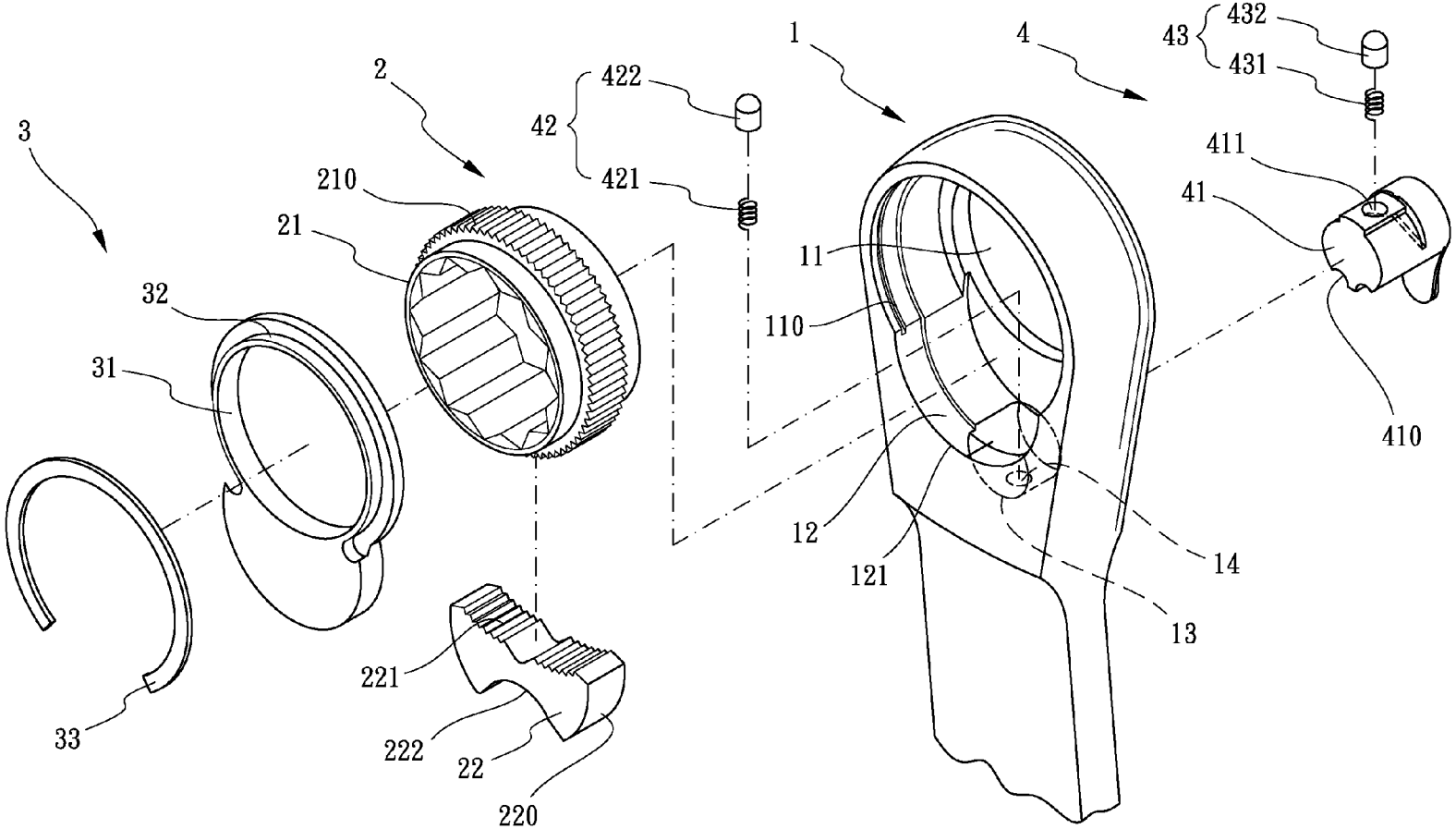
FIG. 2 is an exploded view of the wrench with a ratchet device.
Figure 3:
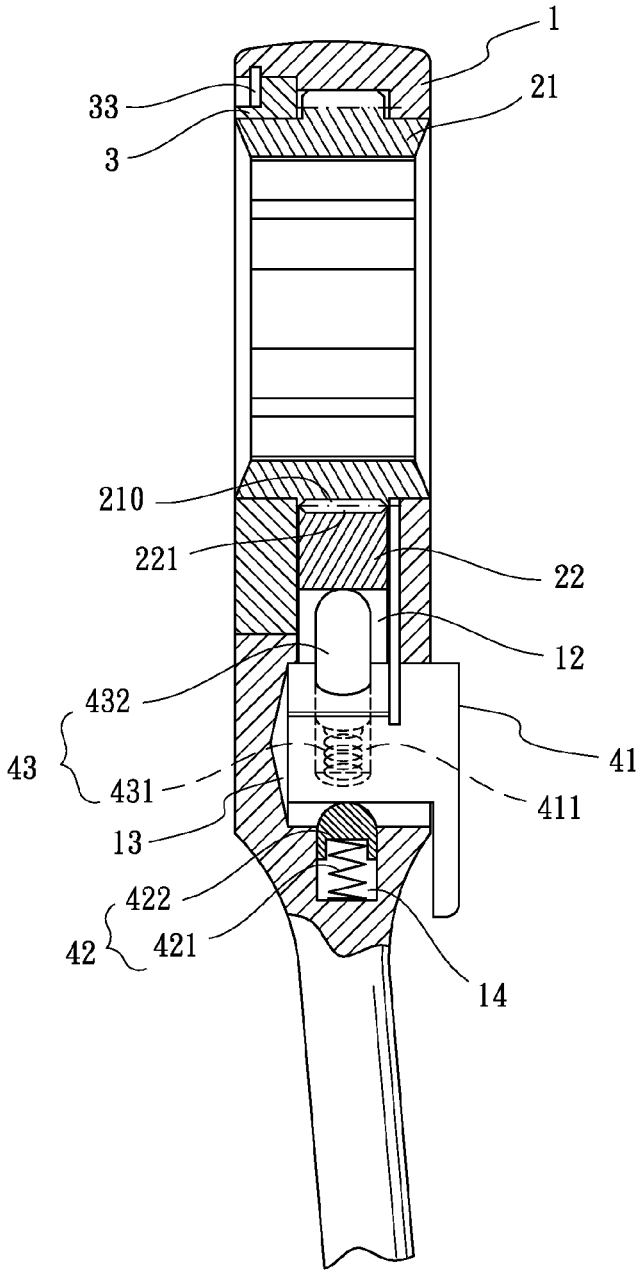
FIG. 3 is a cross-sectional view along line 3-3 shown in FIG. 1 for showing the relationship between a wrench body, a driving set, a cover member and a controlling member.

Referring to the drawings and initially to FIGS. 1-3, a wrench with a ratchet device in accordance with the present invention comprises a wrench body 1, a driving set 2, a cover member 3 and a controlling member 4.

A hole 11 is opened at one end of the wrench body 1 therethrough. A receiving space 12 is axially defined on an inside wall of the hole 11 relative to the wrench body 1. The receiving space 12 is corresponding to another end of the wrench body 1. A side entry 121 is opened on one side of the receiving space 12. An assembling groove 13 is axially defined at a bottom of the receiving space 12 relative to the wrench body 1. The controlling member 4 is assembled into the assembling groove 13. A positioning groove 14 is axially defined at a bottom of the assembling groove 13 relative to the wrench body 1.

The driving set 2 has a ratchet 21 and a driving block 22. The ratchet 21 is assembled into the hole 11. A plurality of teeth 210 is defined around an outer periphery of the ratchet 21. The driving block 22 is assembled into the receiving space 12. Two abutting faces 220 are respectively defined at two ends of the driving block 22. The two abutting faces 220 both abut against the bottom of the receiving space 12. Two engaging parts 221 are defined on one side of the driving block 22. The two engaging parts 221 are close to each other. The two engaging parts 221 are both corresponding to the ratchet 21. The teeth 210 of the ratchet 21 are selectively engaged with one of the two engaging parts 221.

The cover member 3 covers the hole 11 and the side entry 121 of the receiving space 12. A cover opening 31 is opened on the cover member 3. The cover opening 31 is corresponding to the ratchet 21 and is used to sleeve a top of the ratchet 21 so that the ratchet 21 is positioned in the hole 11 (as shown in FIG. 3).

The controlling member 4 has a switching member 41, a first elastomer 42 and a second elastomer 43. The switching member 41 is inserted into the assembling groove 13 and is rotatable relative to the assembling groove 13. The switching member 41 has two indentations 410 defined thereon. The two indentations 410 are close to each other. The positioning groove 14 is selectively corresponding to one of the two indentations 410. The first elastomer 42 is assembled onto the positioning groove 14 to selectively abut against one of the two indentations 410 of the switching member 41. The second elastomer 43 is assembled on the switching member 41 to abut against the driving block 22.

Figure 4:
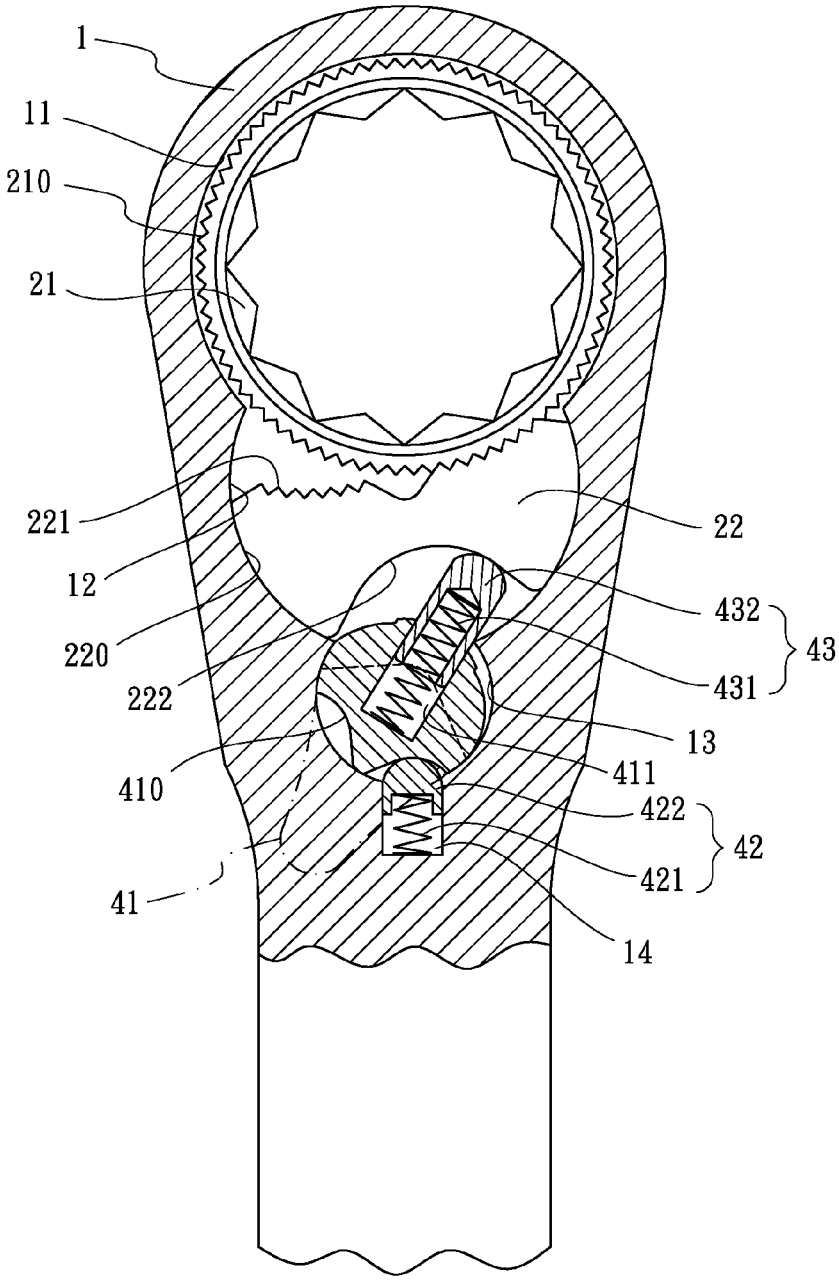
FIG. 4 is a cross-sectional view for showing the controlling member which is clockwise rotated by a user when the user wants to lock a nut with the wrench with a ratchet device.

Under this arrangement, when the ratchet 21 is rotated relative to the wrench body 1 in one direction, the teeth 210 of the ratchet 21 are engaged with one engaging part 221 of the driving block 22; in contrast, when the ratchet 21 is rotated relative to the wrench body 1 in another direction, the teeth 210 of the ratchet 21 are disengaged with one engaging part 221 of the driving block 22 step by step (as shown in FIG. 4).

In addition, the bottom of the receiving space 12 simultaneously abuts against the two abutting faces 220 of the driving block 22 rather than selectively abut against one of the two abutting faces 220 as the prior art, so that the driving block 22 of the present invention is more stable than the prior art when the teeth 210 of the ratchet 21 are engaged with one engaging part 221 of the driving block 22 (as shown in FIG. 4).

Referring to FIG. 2 and FIG. 4, when a user rotates the controlling member 4 clockwise, one engaging part 221 of the driving block 22 engages with the teeth 210 of the ratchet 21. Under this arrangement, when the ratchet 21 of the wrench body 1 fitly sleeves a nut and the user rotates the wrench body 1 clockwise, the ratchet 21 rotates with the rotation of the wrench body 1 because one engaging part 221 of the driving block 22 engages with the teeth 210 of the ratchet 21; in contrast, when the ratchet 21 of the wrench body 1 fitly sleeves a nut and the user rotates the wrench body 1 counterclockwise, the ratchet 21 does not rotate with the rotation of the wrench body 1 because one engaging part 221 of the driving block 22 disengages with the teeth 210 of the ratchet 21 step by step. Therefore, the user can lock the nut via the wrench with a ratchet device of the present invention.

Figure 5:
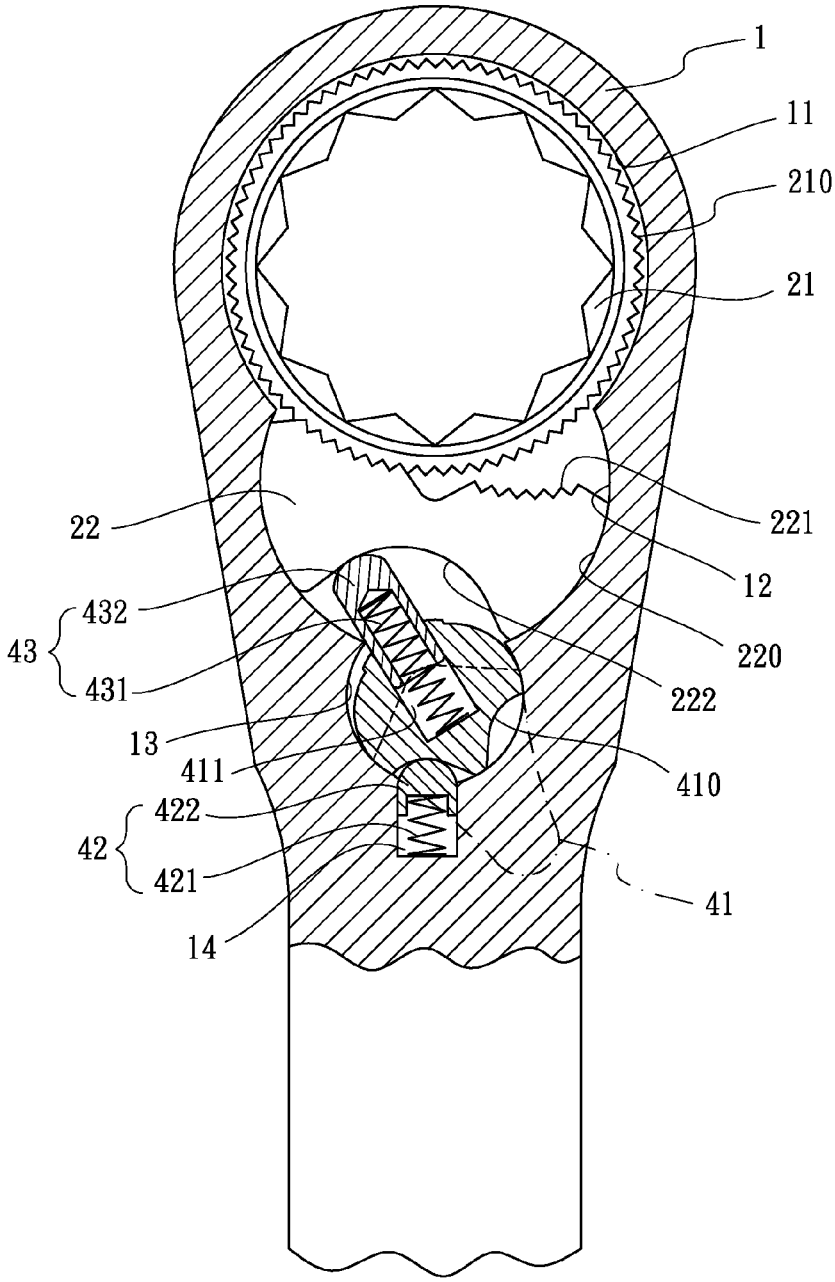
FIG. 5 is a cross-sectional view along line 5-5 shown in FIG. 1 for showing the controlling member which is counterclockwise rotated by the user when the user wants to unlock a nut with the wrench with a ratchet device.

Referring to FIG. 2 and FIG. 5, when the user rotates the controlling member 4 counterclockwise, another engaging part 221 of the driving block 22 engages with the teeth 210 of the ratchet 21. Under this arrangement, when the ratchet 21 of the wrench body 1 fitly sleeves a nut and the user rotates the wrench body 1 counterclockwise, the ratchet 21 rotates with the rotation of the wrench body 1 because another engaging part 221 of the driving block 22 engages with the teeth 210 of the ratchet 21; in contrast, when the ratchet 21 of the wrench body 1 fitly sleeves a nut and the user rotates the wrench body 1 clockwise, the ratchet 21 does not rotate with the rotation of the wrench body 1 because another engaging part 221 of the driving block 22 disengages with the teeth 210 of the ratchet 21 step by step. Therefore, the user can unlock the nut via the wrench with a ratchet device of the present invention.

The present invention has two advantages as following:

1. The bottom of the receiving space 12 simultaneously abuts against the two abutting faces 220 of the driving block 22 rather than selectively abut against one of the two abutting faces 220 as the prior art, so that the driving block 22 of the present invention is more stable than the prior art when the teeth 210 of the ratchet 21 are engaged with one engaging part 221 of the driving block 22.

2. Because the driving block 22 of the present invention is more stable than the prior art when the teeth 210 of the ratchet 21 are engaged with one engaging part 221 of the driving block 22, the driving block 22 of the present invention has a longer life time than the prior art.

Referring to FIG. 2, FIG. 4 and FIG. 5, the bottom of the receiving space 12 is concave-shaped. The two abutting faces 220 of the driving block 22 are both convex-shaped so as to be corresponding to the bottom of the receiving space 12. Under this arrangement, when the driving block 22 is moved by the controlling member 4, each abutting face 220 of the driving block 22 moves relative to the bottom of the receiving space 12 smoothly. In addition, even if the driving block 22 is moving, the two abutting faces 220 of the driving block 22 both abut against the bottom of the receiving space 12 so that the driving block 22 is stable when the driving block 22 is moving. (The shape of the bottom of the receiving space 12, and the shape of each abutting face 220 of the driving block 22 are both not limited by the present invention.).

Furthermore, the further details of the present invention are shown as following:

1. Referring to FIG. 2, FIG. 4 and FIG. 5, the driving block 22 has an attaching groove 222 defined at another end thereof. The attaching groove 222 is corresponding to the second elastomer 43. Under this arrangement, when the user rotates the switching member 41, the second elastomer 43 compresses against the attaching groove 222 of the driving block 22 so that the driving block 22 is moved smoothly.

2. Referring to FIG. 2-5, the switching member 41 has a spring room 411 opened thereon. The spring room 411 is corresponding to the attaching groove 222. One end of the second elastomer 43 abuts against the bottom of the spring room 411, and another end of the second elastomer 43 abuts against the attaching groove 222 of the driving block 22 to smoothly move the driving block 22.

3. Referring to FIG. 2-5, the first elastomer 42 has a first spring 421 and a first positioning component 422. The second elastomer 43 has a second spring 431 and a second positioning component 432. One end of the first spring 421 of the first elastomer 42 abuts against the bottom of the positioning groove 14. Another end of the first spring 421 compresses against the first positioning component 422 so that the first positioning component 422 of the first elastomer 42 selectively abuts against one of the two indentations 410 via the compression of the first spring 421. One end of the second spring 431 of the second elastomer 43 abuts against the bottom of the spring room 411. Another end of the second spring 431 compresses against the second positioning component 432 of the second elastomer 43 so that the second positioning component 432 of the second elastomer 43 abuts against the attaching groove 222 of the driving block 22 via the compression of the second spring 431. Under this arrangement, the switching member 41 can be smoothly rotated by the user.

4. Referring to FIG. 2, a positioning circular groove 32 is defined around a periphery of the cover opening 31 of the cover member 3. A limiting annular groove 110 is defined on the inside wall of the hole 11 of the wrench body 1. The limiting annular groove 110 is corresponding to the positioning circular groove 32. A locking ring 33 is assembled on the positioning circular groove 32. The outer periphery of the locking ring 33 is plugged into the limiting annular groove 110 so that the locking ring 33 is tightly positioned at the inside wall of the hole 11. Therefore, the cover member 3 is locked onto the hole 11 by the locking ring 33, and further prevents the driving set 2 from dropping out from the hole 11 of the wrench body 1.

Although the invention has been explained in relation to its preferred embodiment, it is to be understood that many other possible modifications and variations can be made without departing from the spirit and scope of the invention as hereinafter claimed.

What is claimed is:

1. A wrench with a ratchet device comprising:

a wrench body, a driving set, a cover member and a controlling member;

a hole opened at one end of the wrench body therethrough, a receiving space axially defined on an inside wall of the hole relative to the wrench body, the receiving space being corresponding to another end of the wrench body, a side entry opened on one side of the receiving space, an assembling groove axially defined at a bottom of the receiving space relative to the wrench body, the controlling member assembled into the assembling groove, a positioning groove axially defined at a bottom of the assembling groove relative to the wrench body;

the driving set having a ratchet and a driving block, the ratchet assembled into the hole, a plurality of teeth defined around an outer periphery of the ratchet, the driving block assembled into the receiving space, two abutting faces respectively defined at two ends of the driving block, the two abutting faces both abutting against the bottom of the receiving space, two engaging parts defined on one side of the driving block, the two engaging parts being close to each other, the two engaging parts being both corresponding to the ratchet, the teeth of the ratchet selectively engaged with one of the two engaging parts;

the cover member covering the hole and the side entry of the receiving space, a cover opening opened on the cover member, the cover opening being corresponding to the ratchet and being used to sleeve a top of the ratchet; and the controlling member having a switching member, a first elastomer and a second elastomer, the switching member inserted into the assembling groove and being rotatable relative to the assembling groove, the switching member having two indentations defined thereon, the two indentations being close to each other, the positioning groove being selectively corresponding to one of the two indentations, the first elastomer assembled onto the positioning groove to selectively abut against one of the two indentations of the switching member, the second elastomer assembled on the switching member to abut against the driving block;

wherein when the ratchet is rotated relative to the wrench body in one direction, the teeth of the ratchet are engaged with one engaging part of the driving block; in contrast, when the ratchet is rotated relative to the wrench body in another direction, the teeth of the ratchet are disengaged with one engaging part of the driving block step by step.

2. The wrench with a ratchet device as claimed in claim 1, wherein the driving block has an attaching groove defined at another end thereof; the attaching groove is corresponding to the second elastomer; wherein when the user rotates the switching member, the second elastomer compresses against the attaching groove of the driving block so that the driving block is moved smoothly.

3. The wrench with a ratchet device as claimed in claim 2, wherein the switching member has a spring room opened thereon; the spring room is corresponding to the attaching groove; one end of the second elastomer abuts against a bottom of the spring room, and another end of the second elastomer abuts against the attaching groove of the driving block to smoothly move the driving block.

4. The wrench with a ratchet device as claimed in claim 3, wherein the first elastomer has a first spring and a first positioning component; the second elastomer has a second spring and a second positioning component; one end of the first spring of the first elastomer abuts against the bottom of the positioning groove; another end of the first spring compresses against the first positioning component so that the first positioning component of the first elastomer selectively abuts against one of the two indentations via the compression of the first spring; one end of the second spring of the second elastomer abuts against the bottom of the spring room; another end of the second spring compresses against the second positioning component of the second elastomer so that the second positioning component of the second elastomer abuts against the attaching groove of the driving block via the compression of the second spring.

5. The wrench with a ratchet device as claimed in claim 1, the bottom of the receiving space is concave-shaped; the two abutting faces of the driving block are both convex-shaped so as to be corresponding to the bottom of the receiving space.

6. The wrench with a ratchet device as claimed in claim 1, a positioning circular groove is defined around a periphery of the cover opening of the cover member.

7. The wrench with a ratchet device as claimed in claim 6, a limiting annular groove is defined on the inside wall of the hole of the wrench body; the limiting annular groove is corresponding to the positioning circular groove; a locking ring is assembled on the positioning circular groove; the outer periphery of the locking ring is plugged into the limiting annular groove so that the locking ring is tightly positioned at the inside wall of the hole.

* * * * *